US005385071A

United States Patent [19]

Her

[11] Patent Number: 5,385,071

[45] Date of Patent: Jan. 31, 1995

[54] UNIVERSAL HAND TOOL FOR A BICYCLE

[75] Inventor: Jern-Shong Her, Changhua, Taiwan, Prov. of China

[73] Assignee: Yu Chou Enterprise Corporation, Changhua, Taiwan, Prov. of China

[21] Appl. No.: 172,815

[22] Filed: Dec. 27, 1993

[51] Int. Cl.[6] ..... B25B 23/16

[52] U.S. Cl. ..... 81/177.7; 81/173; 81/177.6

[58] Field of Search ..... 81/165, 173, 177.6, 81/177.7, 177.8

[56] References Cited

U.S. PATENT DOCUMENTS

| | | | |
|---|---|---|---|
| 525,684 | 9/1894 | Friede | 81/173 X |
| 554,522 | 2/1896 | Mills | 81/173 X |
| 613,230 | 11/1898 | Beckwith | 81/173 X |
| 2,097,361 | 10/1937 | Bagley | 81/177.6 |
| 4,028,970 | 6/1977 | Pelczar | 81/165 |
| 4,326,436 | 4/1982 | McGraw | 81/165 |
| 5,230,263 | 7/1993 | Kwaka | 81/177.7 X |

*Primary Examiner*—James G. Smith
*Attorney, Agent, or Firm*—Browdy and Neimark

[57] ABSTRACT

A universal hand tool for a bicycle, including a head section having a movable clamping arm and a fixed clamping arm defining a clamping slot, and a handle section formed with multiple hexagonal holes. The movable clamping arm is disposed with a thread sleeve and fitted on a thread rod of the head section, whereby the movable clamping arm is movable by means of rotating the thread sleeve. A scale ruler is disposed above the thread rod for measuring the sizes of the nuts clamped in the clamping slot. The head portion is formed with a large and a small recesses and cooperative first and second projections under the thread rod for tightening/untightening slotted nuts. A hinge member secured on one side of the head section and the handle section to pivotally connect the same. The head section further has a rectangular recess and the handle section has a corresponding rectangular projection. A fastening hook is secured on the other side of the head section and a fastening loop is secured on the other side of the handle section, whereby the hand tool is able to disassemble all parts of the bicycle and is foldable for easy storage and carriage.

4 Claims, 3 Drawing Sheets

UNIVERSAL HAND TOOL FOR A BICYCLE

BACKGROUND OF THE INVENTION

The present invention relates to a universal hand tool for a bicycle, including a head section and a handle section pivotally connected therewith by a hinge member. The head section has a movable clamping arm and a fixed clamping arm defining a clamping slot. The handle section formed with multiple hexagonal holes. The head portion is formed with a large and a small recesses and cooperative first and second projections for tightening/untightening slotted nuts. A fastening hook is secured on one side of the head section and a fastening loop is secured on one side of the handle section, whereby the hand tool can be locked in a straight operation state by the fastening loop and hook and can be folded after loosening the same for easy storage and carriage.

Conventionally, various hand tools are used for disassembling different parts of a bicycle. Some of these hand tools can at most disassemble two or three kinds of parts, while some of them can only untighten a specific part with specific dimension such as a nut. A bicycle has numerous parts so that there are quite a lot of hand tools are necessary. Such hand tools are manufactured at high cost and great space are occupied thereby so that the storage and carriage thereof are difficult. Moreover, it is often hard to quickly find a suitable hand tool from the various ones. Therefore, it is necessary to provide a universal hand tool for a bicycle, which is suitable for all the parts of the bicycle. The universal hand tool can be manufactured at low cost. Moreover, the universal hand tool has less weight and volume for easy storage and carriage.

SUMMARY OF THE INVENTION

It is a primary object of the present invention to provide a universal hand tool for a bicycle, which is suitable to disassemble all the parts of the bicycle.

It is a further object of the present invention to provide the above hand tool which includes a head section and a handle section pivotally connected therewith by a hinge member. The hand tool is unlockably locked in a operation state by a fastening loop and a fastening hook disposed respectively on the head section and handle section. When the fastening loop and hook are loosened, the hand tool can be folded to facilitate the storage and carriage thereof.

According to the above objects, the hand tool of the present invention includes a head section having a movable clamping arm and a fixed clamping arm defining a clamping slot, and a handle section formed with multiple hexagonal holes. The movable clamping arm is disposed with a thread sleeve and fitted on a thread rod of the head section, whereby the movable clamping arm is movable by means of rotating the thread sleeve. A scale ruler is disposed above the thread rod for measuring the sizes of the nuts clamped in the clamping slot. The head portion is formed with a large and a small recesses and cooperative first and second projections under the thread rod for tightening/untightening slotted nuts. A hinge member is secured on one side of the head section and the handle section to pivotally connect the same. The head section further has a rectangular recess and the handle section has a corresponding rectangular projection. A fastening hook is secured on the other side of the head section and a fastening loop is secured on the other side of the handle section, whereby the hand tool is able to disassemble all parts of the bicycle and is foldable for easy storage and carriage.

The present invention can be best understood through the following description and accompanying drawing, wherein:

DETAILED DESCRIPTION OF THE PREFERRED EMBODIMENT

Figure 1:
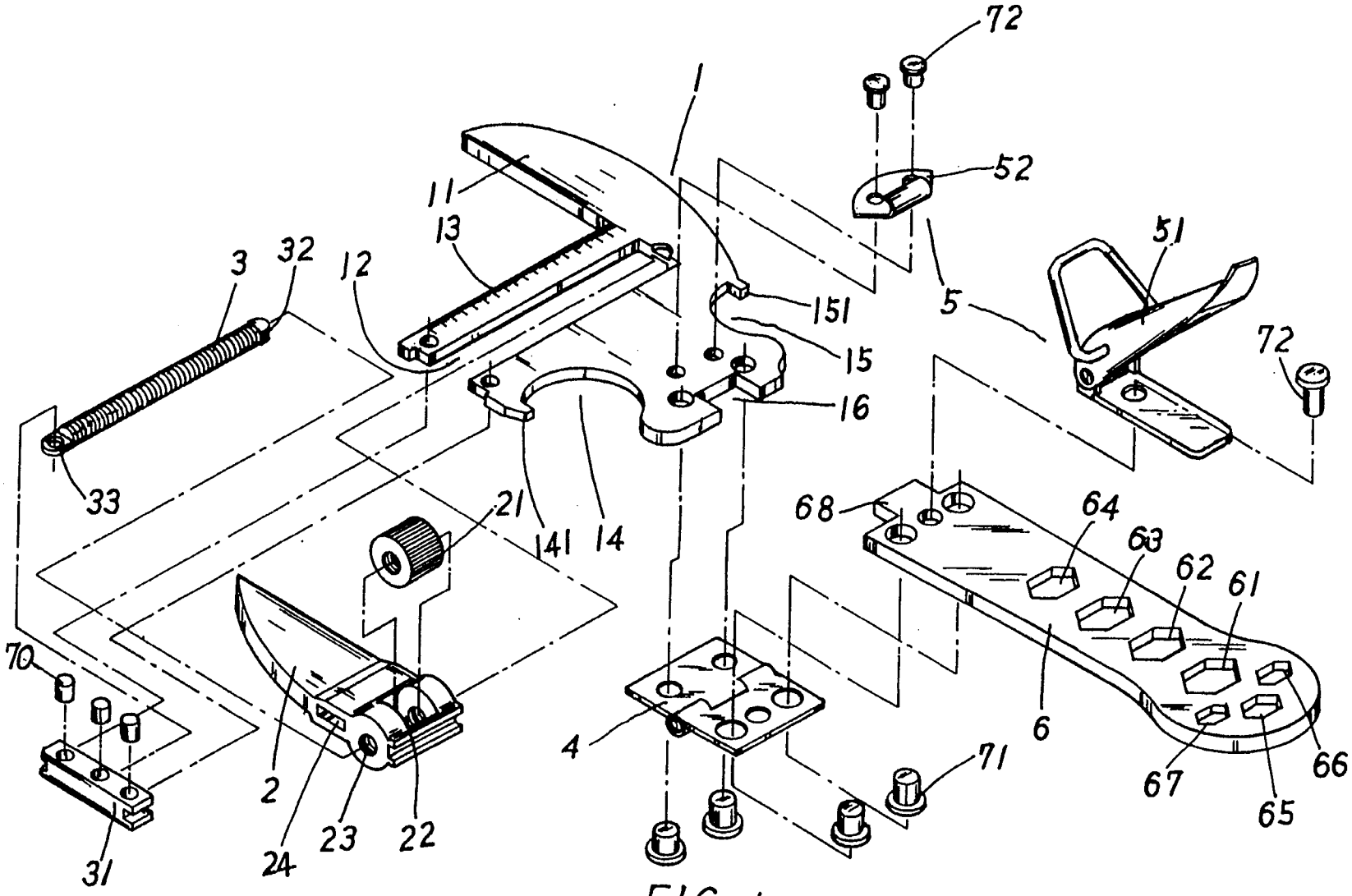
FIG. 1 is a perspective exploded view of the present invention.

Please refer to FIG. 1. The hand tool of the present invention includes a head section 1, a movable clamping arm 2, a cylindric thread sleeve 21, a thread rod 3, a fixing block 31, a hinge member 4, a fastening member 5, a handle section 6, and rivet pins 70, 71, 72. The head section 1 includes a fixed clamping arm 11, a thread rod slot 12, a scale ruler 13, a large arch recess 14, a first projection 141 of the large arch recess 14, a small arch recess 15, a second projection 151 of the small arch recess 15, and a rectangular recess 16. The movable clamping arm 2 is formed with an upper thread sleeve hole 22, an insert through hole 23 and a middle flat fitting hole 24. The thread rod 3 has a head portion formed with a cut 32 and a flat tail portion formed with a circular hole 33. The fastening member 5 is composed of a fastening loop 51 and a fastening hook 52. The handle section 6 is formed with multiple hexagonal holes 61, 62, 63, 64, 65, 66, 67 and a rectangular projection 68 corresponding to the rectangular recess 16 of the head section 1.

Figure 2:
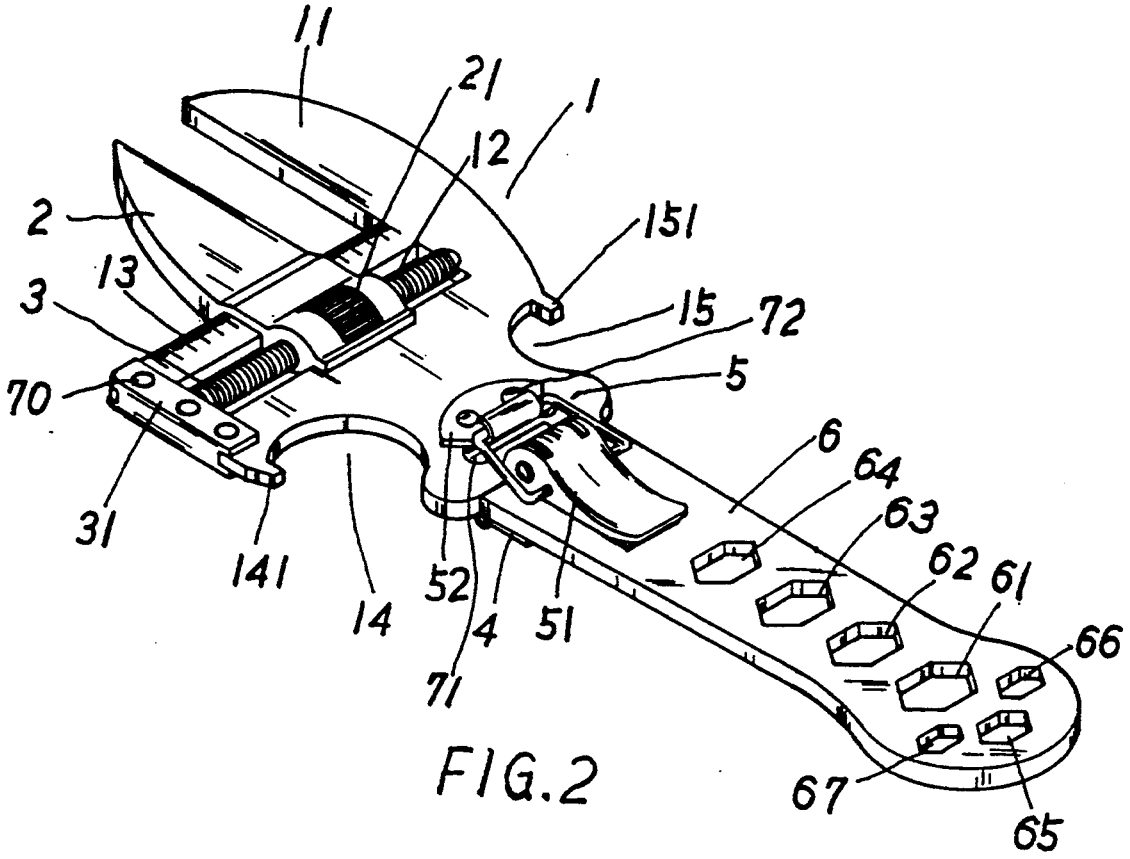
FIG. 2 is a perspective assembled view of the present invention.

Please refer to FIG. 2. The thread rod 3 is extended into the thread rod slot 12 of the head section 1 with the cut 32 opposed against an end of the slot 12 and welded therewith. The thread sleeve 21 is placed in the thread sleeve hole 22 of the movable clamping arm 2 and the movable clamping arm 2 together with the thread sleeve 21 is fitted onto the thread rod 3 and the scale ruler 13 which respectively go through the insert hole 23 and the fitting hole 24 of the movable clamping arm 2. The fixing block 31 is fitted at an open end of the thread rod slot 12 with the flat tail portion of the thread rod 3 inserted into the fixing block 31 and secure therewith by rivet pin 70. The hinge member 4 is secured on one side of the head section 1 and the handle section 6 by rivet pins 71 to pivotally connect the head section 1 and handle section 6. In addition, the rectangular recess 16 of the head section 1 is fitted with the rectangular projection 68 of the handle section 6. The fastening hook 52 is secured on the other side of the head section 1 by rivet pins 72 and the fastening loop 51 is secured on the other side of the handle section 6 by rivet pins 72. The fastening loop 51 is suitable to lock the fastening hook 52.

Figure 3:
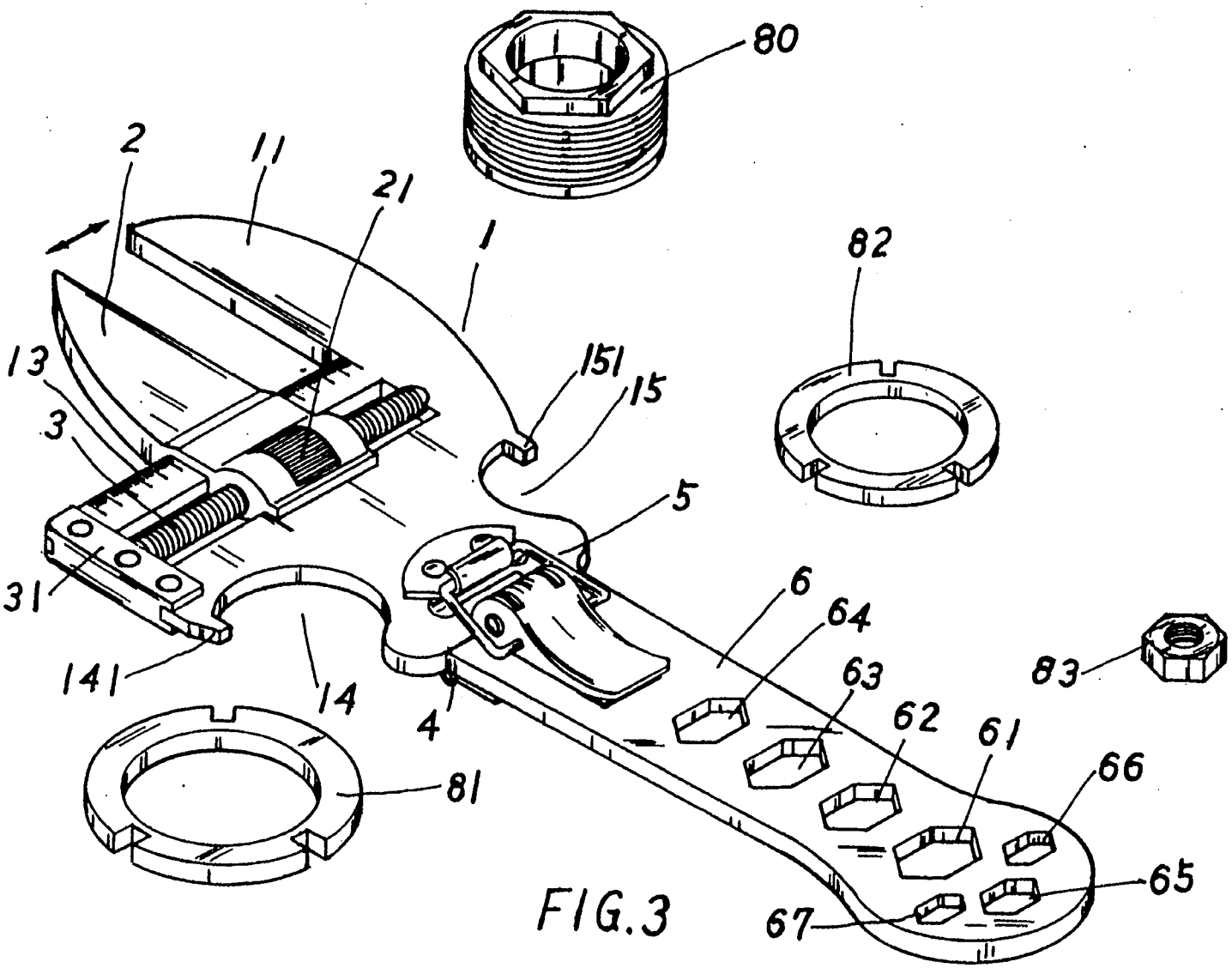
FIG. 3 is a perspective view illustrating the function of the present invention.

Please refer to FIG. 3. The movable clamping arm 2 is movable by means of rotating and moving the thread sleeve 21 along the thread rod 3 so as to vary the space between the movable and fixed clamping arms 2, 11 for tightening/untightening various kinds of hexagonal nuts 80. The scale ruler 13 serves to measure the dimension of the nut. The large arch recess 14 and the first projection 141 Of the head section 1 serve to tighten-/untighten large slotted nut 81, while the small arch recess 15 and the second projection 141 serve to tighten/untighten small slotted nut 82. The hexagonal holes 61, 62, 63, 64, 65, 66, 67 serve to tighten/untighten general hexagonal nuts 83 of a bicycle.

Figure 4:
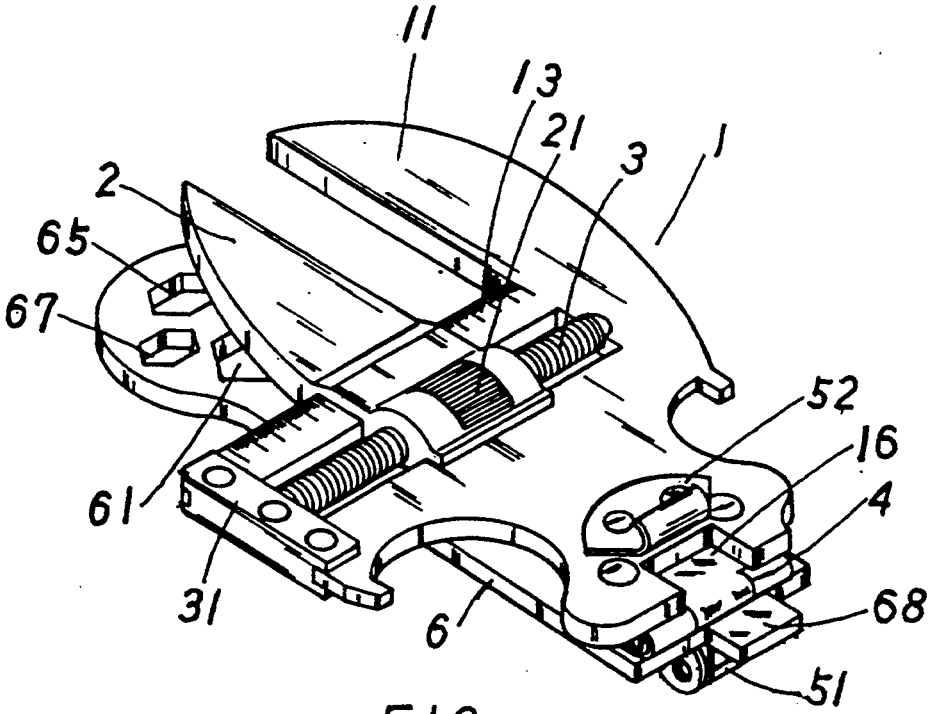
FIG. 4 is a perspective view of the present invention in a folded state.

Please refer to FIG. 4. When the present invention is not used, the fastening loop 51 is separated from the fastening hook 52, permitting the hand tool to be folded up by means of the hinge member 4 so as to reduce occupied room and facilitate storage and carriage of the hand tool.

It is to be understood that the above description and drawings are only used for illustrating one embodiment of the present invention, not intended to limit the scope thereof. Any variation and derivation from the above description and drawings should be included in the scope of the present invention.

What is claimed is:

1. A universal hand tool for a bicycle, comprising a head section having a movable clamping arm and a fixed clamping arm defining a clamping slot for tightening/untightening various nuts with different sizes, and a handle section formed with multiple hexagonal holes for tightening/untightening general hexagonal nuts of the bicycle, said movable clamping arm being movable by means of rotating a thread sleeve fitted on a thread rod of said head section so as to vary the dimension of said clamping slot, a scale ruler being disposed above said thread rod for measuring the sizes of the nuts, said head portion being formed with large and small recesses and cooperative first and second projections under said thread rod for tightening/untightening slotted nut, a hinge member being secured on one side of said head section and said handle section to pivotally connect said head section and handle section, said head section further having a rectangular recess and said handle section having a corresponding rectangular projection, a fastening hook being secured on the other side of said head section and a fastening loop being secured on the other side of said handle section, whereby said fastening loop is suitable to unlockably lock said fastening hook with said rectangular recess fitted with said rectangular projection so as to firmly connect said head section and handle section in a straight state, and when said fastening loop and fastening hook are detached, said hand tool is permitted to be folded up by means of said hinge member so as to reduce occupied room for facilitate storage and carriage of said hand tool.

2. A hand tool as claimed in claim 1, wherein said fixed clamping arm is integrally formed on said head section while on said movable clamping arm is formed an upper thread sleeve hole for receiving said thread sleeve, an insert through hole and a middle flat fitting hole, whereby said movable clamping arm together with said thread sleeve is fitted onto said thread rod and said scale ruler with the same respectively going through said insert through hole and said middle flat fitting hole of said movable clamping arm, a fixing block being disposed at one end of said thread rod to fix said movable clamping arm and said thread sleeve.

3. A hand tool as claimed in claim 1, wherein said thread rod has a head portion formed with a cut and a flat tail portion formed with a circular hole, and said thread rod being extended into a thread rod slot of said head section with said cut opposed against an end of said thread rod slot and fixed therewith, a fixing block being fitted at an open end of said thread rod slot with said flat tail portion of said thread rod inserted into said fixing block and secure therewith.

4. A hand tool as claimed in claim 1, wherein said hinge member, fastening loop and fastening hook are fixed on said head section and handle section by rivet pins.

* * * * *